US006231165B1

(12) United States Patent
Komuro

(10) Patent No.: US 6,231,165 B1
(45) **Date of Patent: *May 15, 2001**

(54) INKJET RECORDING HEAD AND INKJET APPARATUS PROVIDED WITH THE SAME

(75) Inventor: Hirokazu Komuro, Yokohama (JP)

(73) Assignee: Canon Kabushiki Kaisha, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/854,628

(22) Filed: May 12, 1997

(30) Foreign Application Priority Data

May 13, 1996 (JP) ..... 8-142209

(51) Int. Cl.[7] ..... B41J 2/05

(52) U.S. Cl. ..... 347/58

(58) Field of Search ..... 347/57, 56, 63, 347/58, 12

(56) References Cited

U.S. PATENT DOCUMENTS

| | | | | |
|---|---|---|---|---|
| 4,596,994 | * | 6/1986 | Matsuda et al. | 347/64 |
| 4,860,033 | | 8/1989 | Shiozaki et al. | 347/64 |
| 4,881,318 | | 11/1989 | Komuro et al. | 29/827 |
| 5,121,143 | * | 6/1992 | Hayamizu | 347/63 |
| 5,322,811 | | 6/1994 | Komuro et al. | 347/59 |
| 5,479,197 | | 12/1995 | Fujikawa et al. | 347/63 |
| 5,485,185 | | 1/1996 | Sueoka et al. | 347/64 |
| 5,491,505 | | 2/1996 | Suzuki et al. | 347/203 |
| 5,550,568 | * | 8/1996 | Misumi | 347/12 |
| 5,563,642 | * | 10/1996 | Keefe et al. | 347/84 |
| 5,580,468 | | 12/1996 | Fujikawa et al. | 216/27 |
| 5,649,359 | | 7/1997 | Murakami et al. | 347/45 |

FOREIGN PATENT DOCUMENTS

| | | | | |
|---|---|---|---|---|
| 0 461 935 | | 12/1991 | (EP) . | |
| 0 532 877 | | 3/1993 | (EP) . | |
| 54-51837 | | 4/1979 | (JP) . | |
| 57-72867 | | 5/1982 | (JP) . | |
| 57-201676 | | 12/1982 | (JP) . | |
| 59-95154 | | 6/1984 | (JP) . | |
| 61-239959 | | 10/1986 | (JP) . | |
| 62-013367 | | 1/1987 | (JP) . | |
| 5-338208 | * | 12/1993 | (JP) | 347/58 |

* cited by examiner

*Primary Examiner*—John Barlow
*Assistant Examiner*—Michael S. Brooke
(74) *Attorney, Agent, or Firm*—Fitzpatrick, Cella, Harper & Scinto

(57) ABSTRACT

An inkjet recording head and an inkjet recording apparatus capable of mounting the inkjet recording head. The inkjet recording head includes a plurality of electrothermal conversion members, a plurality of driving elements, a plurality of discharge openings, a common wiring, an ink path, and an ink supply opening. Each electrothermal conversion member includes a heating resistor and a pair of electrodes. Each driving element is electrically connected to one of the pair of electrodes of its associated electrothermal conversion member. The common wiring is electrically connected to the other of the pair of electrodes of each electrothermal conversion member. The heating resistors are disposed along the ink supply opening in the longitudinal direction thereof such that their shortest distances from the ink supply opening differ based on the time-sharing driving timings. The wiring resistance values of at least one electrode of each of the pairs of electrodes are substantially the same for all of the electrothermal conversion members. The inkjet recording apparatus is capable of mounting the inkjet head and includes a carriage capable of scanning in a direction of arrangement of the heating resistors and in a direction perpendicular to the direction of arrangement, while the carriage carries the head.

9 Claims, 6 Drawing Sheets

INKJET RECORDING HEAD AND INKJET APPARATUS PROVIDED WITH THE SAME

BACKGROUND OF THE INVENTION

1. Field of the Invention

The present invention relates to an inkjet recording head which ejects ink from an orifice in the form of ink droplets, and an inkjet apparatus using the inkjet recording head. More particularly, the present invention relates to an inkjet recording head which ejects ink in a direction perpendicular to a substrate, is provided with heaters that are driven in a time-sharing fashion, and causes the ink to land on the proper location on the recording medium by shifting the position of the heater and the corresponding discharge opening, since the time-sharing driving causes the location where the ink lands to be shifted; and an inkjet apparatus using the inkjet recording head.

2. Description of the Related Art

An inkjet recording method, disclosed for example in Japanese Patent Laid-Open No. 54-51837, is different from other inkjet recording methods in that the action of thermal energy on ink is used as the driving force for discharging ink droplets. More specifically, in the recording method of the aforementioned disclosure, heating the ink produces air bubbles therein that form the ink into ink droplets that are discharged from an orifice (discharge opening) at the front end of the recording head and adhere onto a recording medium, whereby information is recorded on the recording medium.

In general, the recording head used in this recording method includes an ink discharge section, a heating resistor (heater), an upper protective layer, and a lower protective layer. The ink discharge section has an orifice for discharging ink, and an ink path communicating with the orifice and forming part of a heat-acting section, where thermal energy acts upon ink in order to discharge ink in the form of droplets. The heating resistor serves as an electrothermal conversion member that is a means which produces thermal energy. The upper protective layer protects the heater from ink, while the lower layer accumulates heat.

In order to take full advantage of the characteristics of the above-described head, it is necessary to use a larger number of heaters, which are disposed close together in a high-density arrangement for high-speed operation.

A larger number of heaters results in a larger number of electrical connections with an external wiring plate. In addition, when the heaters are disposed close together in a high-density arrangement, the pitch between the heater electrodes becomes smaller, which makes it impossible to make electrical connections using ordinary electrical connection methods, such as wire bonding.

In Japanese Patent Laid-Open No. 57-72867, this problem is overcome by forming a driving element on a substrate.

Japanese Patent Laid-Open No. 59-95154 discloses a recording head of the type that discharges ink in a direction perpendicular to a heat-acting portion surface by adhering an orifice plate to a substrate.

In general, when such a head has a large number of heaters, the heaters are driven in a time-sharing fashion in order to lower the peak voltage that occurs when all of the heaters are driven.

When the heaters are driven in a time-sharing fashion, however, a voltage is applied to heaters at different times, so that the discharge timing differs, causing ink to land on the recording paper in a zigzag fashion.

To overcome such a problem in the recording head of the above-described type, a proposal has been made to shift the positions of the heaters in accordance with the timing of the time-sharing driving.

FIG. 5 is a view showing the vicinity of the heaters 202-1 and 202-2 in a conventional recording head. As shown in FIG. 5, when the driving elements 205 are arranged side by side and a common electrode is formed on the driving elements, the resistance of a selection electrode varies with the position of the heater, since a shift in the heater position changes the separation distances between the heater and the driving element wiring.

In addition, since the distance between the heater and the common electrode changes, the resistance value of the wiring between the heater and the common electrode changes.

Further, the aforementioned pattern has the following two problems. The first problem is that the wirings, which pass between the heaters, get in the way when the heaters are disposed very close together in a high-density arrangement. In addition, it becomes difficult to operate the heaters at a high frequency, since they can be less freely arranged in the lateral direction. The second problem is that a folded electrode, provided between the heater and the ink supply opening 208, increases the distance between the heater and the ink supply opening and thus increases the flow resistance between the heater and the ink supply opening. This deteriorates the discharge frequency characteristics, so that discharge cannot be performed at a high frequency.

Accordingly, in order to overcome the above-described problem, a proposal was made to form the pattern without the folded electrodes between the heaters 202-1 and 202-2 and the ink supply opening 208, as shown in FIG. 6.

In such a pattern, however, shifting the heater position causes the distances between the heaters and the driving elements 205 to become different, as well as the distances between the heaters and the common electrode to be different, thereby causing the resistance values of the individual selection wirings of the heaters, as well as the resistance values of the wirings between the heaters to be different. Therefore, a different voltage is applied to the heaters, which results in poor printing performance. In the worst case, ink cannot be discharged, depending on the heater position.

Accordingly, with the pattern shown in FIG. 6, it is necessary to design the electrodes and the driving elements such that a fixed voltage is applied to the heaters, in accordance with their positions. In particular, it is necessary to give good consideration to the method of correcting the resistances, since the wiring resistances can only be corrected within a narrow space between the driving elements and the heaters, when forming a driving element to the substrate.

Accordingly, an object of the present invention is to provide an inkjet recording head which can provide a constant discharge performance, without variations in the print quality, by applying a fixed voltage to each of the shifted heaters. In the inkjet recording head, ink is discharged perpendicular to the substrate, and heaters that are driven in a time-sharing fashion are provided. The time-sharing driving causes the landing location of the ink on the recording medium to be shifted. Thus, the ink is made to land on the proper location by shifting the location of the heaters and the corresponding discharging openings.

SUMMARY OF THE INVENTION

To this end, according to the present invention, there is provided an inkjet recording head, comprising: a plurality of electrothermal conversion members, each member including a heating resistor used for discharging ink and a pair of electrodes electrically connected to the heating resistor; a plurality of driving elements, each element being electrically connected to one of the pair of electrodes of its associated electrothermal conversion member in order to drive its associated heating resistor; a common wiring electrically connected to the other of the pair of electrodes of each of the plurality of electrothermal conversion members; a plurality of discharge openings used for discharging ink, which are provided upwardly of the heating resistors in correspondence with their respective heating resistors; an ink path which communicates with the discharge openings; and a slot-shaped ink supply opening for supplying the ink to the ink path. In the inkjet recording head, the plurality of heating resistors are disposed along the ink supply opening in the longitudinal direction thereof such that the shortest distances of the plurality of heating resistors from the ink supply opening differ based on the time-sharing driving timings of the heating resistors. In addition, the wiring resistance values of at least one electrode of each of the pairs of electrodes are substantially the same for all of the electrothermal conversion members.

According to the present invention, a structure may be adopted that allows a fixed voltage to be applied to each of the heaters by changing at least the width of the individual selection electrode wiring with respect to each heater and the width of the wiring between each heater and the common electrode.

In addition, according to the present invention, a structure may be adopted that allows a fixed voltage to be applied to each of the heaters by changing at least the connecting locations of the driving element wiring and the individual electrode wiring for each heater and the connecting locations of the wirings between each heater and the common electrode.

Further, according to the present invention, a structure may be adopted that allows a fixed voltage to be applied to each of the heaters by changing the position of the driving element with respect to each heater.

Still further, according to the present invention, a structure may be adopted that allows a fixed voltage to be applied to each of the heaters by correcting the resistances of the electrical power wirings used to apply electrical power to the driving elements, in relation to each of the heaters.

DESCRIPTION OF THE PREFERRED EMBODIMENTS

Figure 1:
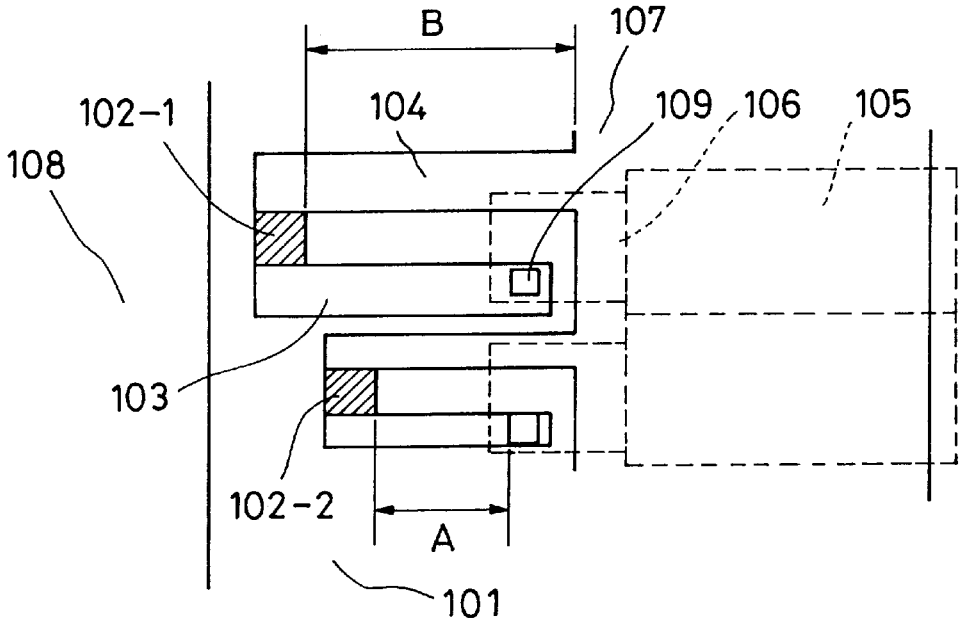
FIG. 1 is a detailed view of the vicinity of the heaters in Embodiment 1 in accordance with the present invention.

As described above, a fixed voltage can be applied to each of the shifted heaters by a structure that allows the electrode wiring width to be changed in accordance with the position of the heater so as to fix the value of the wiring resistance.

More specifically, the heater is made thicker when there is a large separation distance between the heater and the connecting section with the driving element wiring, or a large separation distance between the heater and a common electrode, whereas the heater is made thinner when either of these separation distances are small.

When the wiring width is to be changed, either the electrode between the heater and the driving element wiring, or the electrode between the heater and the common electrode, or both may be changed in width.

In addition, a fixed voltage can be applied to the heaters by fixing the separation distance between the heater to the connecting location with the driving element wiring, or fixing the separation distance between the heater and the connecting location of the common electrode wiring. This method is used, when the electrode between the heater and the driving element or the distance between the heater and the common electrode is on the whole short, or when resistance value corrections cannot be conducted therebetween, or when wiring corrections cannot be done in accordance with the design, since the wiring over-etch amount is not constant, or when the distance between the connecting location with the driving element wiring and the heater is fixed in order to prevent ink from coming into contact with the connecting location.

Since the driving element electrodes can be made wider, the resistance values are substantially unchanged, even when the distances between the connecting locations and the driving elements differ.

The common electrode has a large width, even when the connecting location of the wiring between the heater and the common electrode changes.

To change the connecting location, either the separation distance between the heater and the connecting location with the driving element, or the distance between the heater and the common electrode, or both may be changed.

The problem of different resistance values due to different separation distances between the connecting location of the driving element wiring and the driving element can be overcome by shifting the position of the driving element.

When it is difficult to shift the driving element, such as when it is difficult to route the logic wiring, a fixed voltage can be applied to the heaters by correcting the resistance value of an electrical power wiring used to input electrical power to the driving element.

The resistance value can be corrected by correcting the width of the wiring between the driving element and the electrical power wiring or by fixing the distance between the connecting location and the driving element.

The various methods, which have been discussed for achieving the object, may be used singly or in combination. It is preferable that the object is achieved by an optimum combination when the positioning the heaters.

A description will now be given of the preferred embodiments.

Embodiment 1

Figure 7:
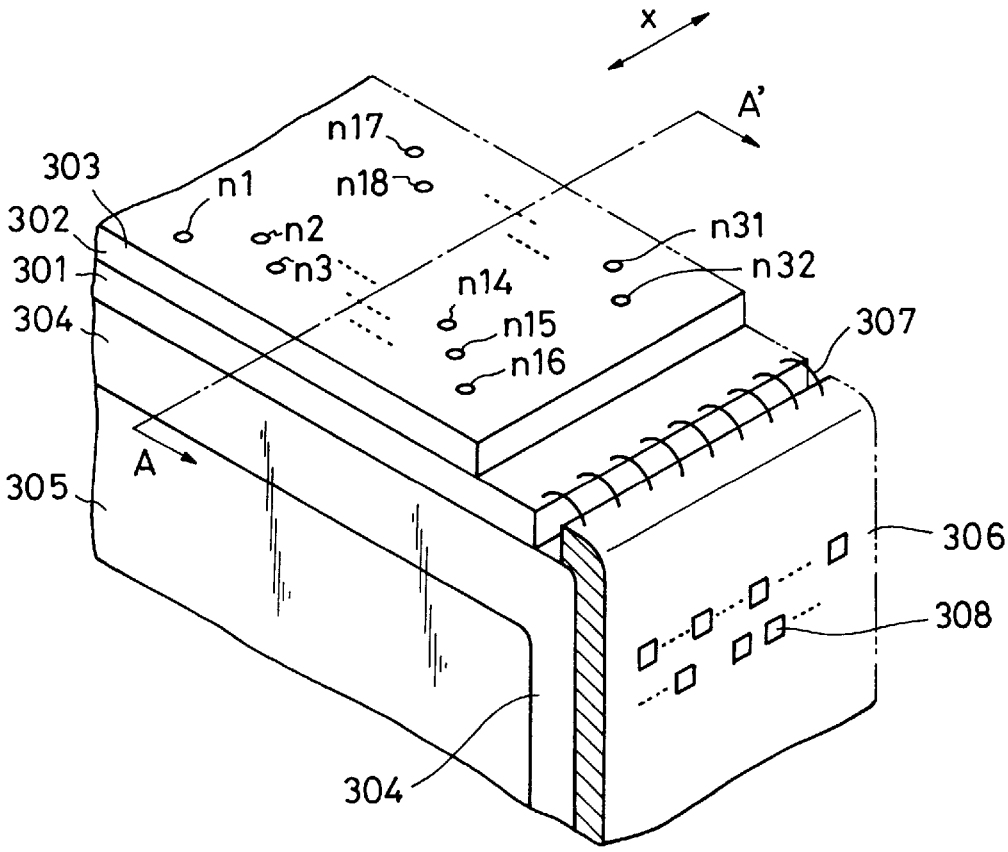
FIG. 7 is a schematic perspective view of an inkjet recording head of the present invention.

FIG. 7 is a perspective view of an inkjet recording head of the present embodiment.

The inkjet recording head of the present invention is a bubble jet type head which discharges ink in a direction perpendicular to a heater by the pressure of high-pressure air bubbles produced by applying voltage in the form of pulses to the heater formed on a substrate. In FIG. 7, reference numeral 301 denotes a silicon (Si) substrate, reference numeral 302 denotes a layer forming an ink path wall, and reference numeral 303 denotes an orifice plate with discharge openings. Reference numeral 304 denotes an L-shaped aluminum (Al) base plate, with one side of the L-shaped face joined to the substrate 301. Reference numeral 305 denotes a tank which contains ink.

Reference numeral 306 denotes a flexible cable, reference numeral 307 denotes a bonding wire for connecting a wiring on the substrate 301 and the flexible cable 306, and reference numeral 308 denotes an electrical contact for electrical connection with the apparatus body side of a printer carriage carrying the head.

Reference numerals n1 to n32 denote discharge openings in the orifice plate 303, which are arranged in two rows, with the rows displaced by ½ the pitch of the discharge openings. That is, the discharge openings n1 to n32 are arranged in a zigzag fashion. The head is carried by the carriage of a printer to be described later and discharges ink as the head moves in the direction of arrow x of FIG. 7.

Figure 8:
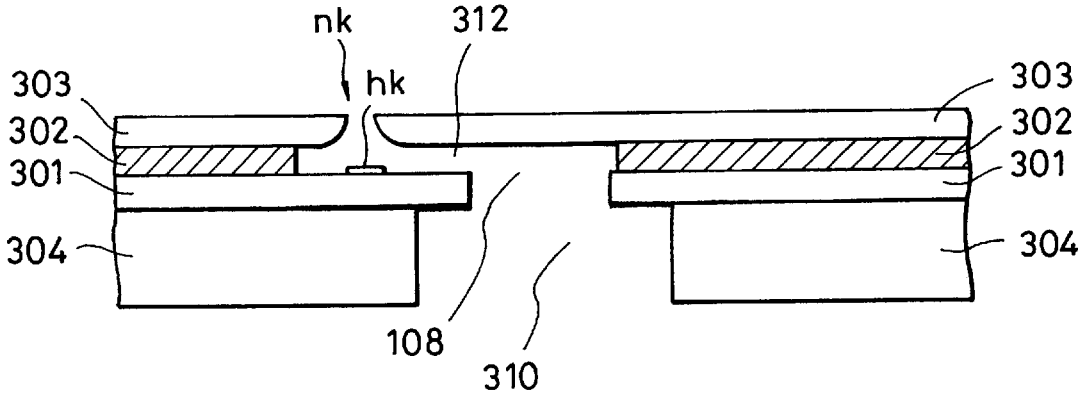
FIG. 8 is a sectional view of the main portion of the inkjet recording head taken along line A–A' of FIG. 7.

FIG. 8 is a sectional view showing the main portion of the inkjet recording head taken along line A–A' of FIG. 7.

From an ink tank 305, ink flows through a hole 310 in a base plate 304, through a hole 108 (hereinafter referred to as "ink supply opening") in the Si substrate 101, through an ink path 312 to a chamber including a heater, and is discharged from each discharge opening nk (k=1, 2, . . . , 32). In FIG. 8, reference character hk (k=1, 2, . . . , 32) denotes a heater formed on the Si substrate 301. The heaters, provided in correspondence with the discharge openings, are disposed directly below their corresponding discharge openings such that the center of each heater is aligned with the center of its associated discharge opening.

Figure 9:
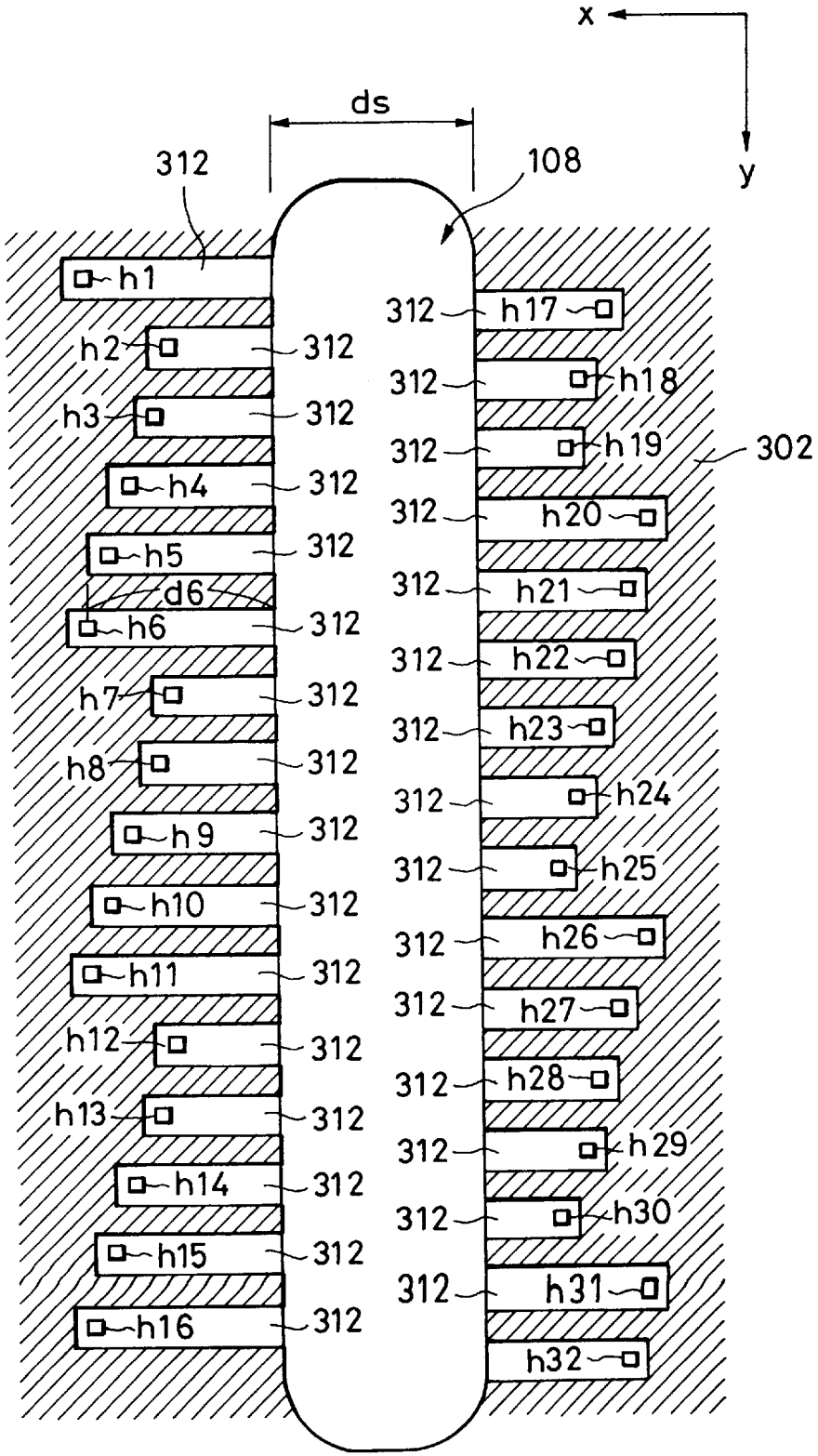
FIG. 9 is a view showing the form of each ink path and the arrangement of the heaters in the inkjet recording head of FIG. 7.

FIG. 9 is a view showing the shape of each ink path 312 and the arrangement of each heater hk in its associated ink path.

In FIG. 9, the relative positions of the heaters hk correspond to the relative positions of the discharge openings nk. The heaters h1 to h16 are displaced with respect to the heaters h17 to h32 by ½ the pitch of the discharge openings, as mentioned above.

The head has 32 heaters that are driven 16 times, the timings of which are previously set based on the time-sharing for an equal number of heaters. Therefore, a maximum of two heaters are driven at the same timing in accordance with the discharge data. In the present embodiment, the phrase "distance from an edge of an ink supply opening" refers to the distance from the left edge of the ink supply opening when speaking of the left row heaters, while the same phrase refers to the distance from the right edge of the ink supply opening when speaking of the right row heaters.

In the inkjet recording head of the present embodiment, the two heaters driven at the same timing always causes the ink to land on locations separated by a 10-dot pitch in the main scanning direction, or in the direction of carriage movement.

FIG. 1 is a detailed plan view showing the vicinity of the heaters in Embodiment 1 in accordance with the present invention. Reference numeral 101 denotes a substrate, reference numerals 102 denote heaters, reference numeral 103 denotes a selection electrode, reference numeral 104 denotes a wiring electrode between the heaters and a common electrode, reference numeral 105 denotes a driving element, reference numeral 106 denotes a driving element wiring, reference numeral 107 denotes the common electrode, and reference numeral 108 denotes an ink supply opening.

In preparing the recording head of the present embodiment, the driving elements and logic elements are formed on the silicon substrate by the bi-CMOS process.

The pitch of the driving element is the same as the pitch of the heater, which is 300 dpi.

In the final step of preparing the driving element, the wiring electrodes of the driving elements are prepared using Al—Cu material that is formed into a thickness of 1.0 $\mu$m, followed by patterning and preparation of an inter-layer insulating layer formed from $SiO_2$ material that is formed into a thickness of 1.5 $\mu$m.

Then, a 20 $\mu$m×20 $\mu$m through hole 109 is etched in a location of each inter-layer protective layer where the driving element wiring and an individual electrode of the heater are connected together.

The heater is formed from TaN material that is formed into a thickness of 0.1 $\mu$m.

On the heater is formed an electrode layer formed from Al material that is formed into a thickness of 0.6 $\mu$m, followed by patterning using photolithography, as shown in FIG. 1.

Each heater is 30 $\mu$m×30 $\mu$m large.

As shown in FIG. 1, the heater 102-1 and the heater 102-2 are disposed at different distances from the ink supply opening 108.

The distance A between a heater side end of the through hole 109 that is a connecting portion with the driving element wiring and an end of the heater electrode is 100 $\mu$m for the heater 102-1 and 75 $\mu$m for the heater 102-2.

The distance B between an end of the heater electrode and the common electrode is 150 $\mu$m for the heater 102-1 and 125 $\mu$m for the heater 102-2.

Therefore, when the electrode wirings have the same width, the resistance of the electrode wiring for the heater 102-1 is 1.25 times the resistance of the electrode wiring for the heater 102-2. Therefore, when the heater wirings are of the same width, the voltage applied to the heaters are different, causing the heaters to have different discharge characteristics, thereby deteriorating printing characteristics.

Therefore, in the present embodiment, the resistance of the wirings are corrected by changing the thickness of the wirings.

The width of the selection electrode between the heater and the driving element and the width of the wiring electrode between the heater and the common electrode are both 20 $\mu$m for the heater 102-1 and 16 $\mu$m for the heater 102-2. When the thickness of the wiring for the heater 102-1 is made 1.25 times the thickness of the wiring for the heater 102-2, the resistance of the wiring for the heater 102-2 between the heater side end of the through hole 109, being a connecting portion with the driving element wiring, and an end of the heater electrode is the same as the resistance of the wiring for the heater 102-1 between an end of the heater electrode and the common electrode.

In addition, the same voltage is applied to the heaters since the electrode resistance values are the same.

Embodiment 2

Figure 2:
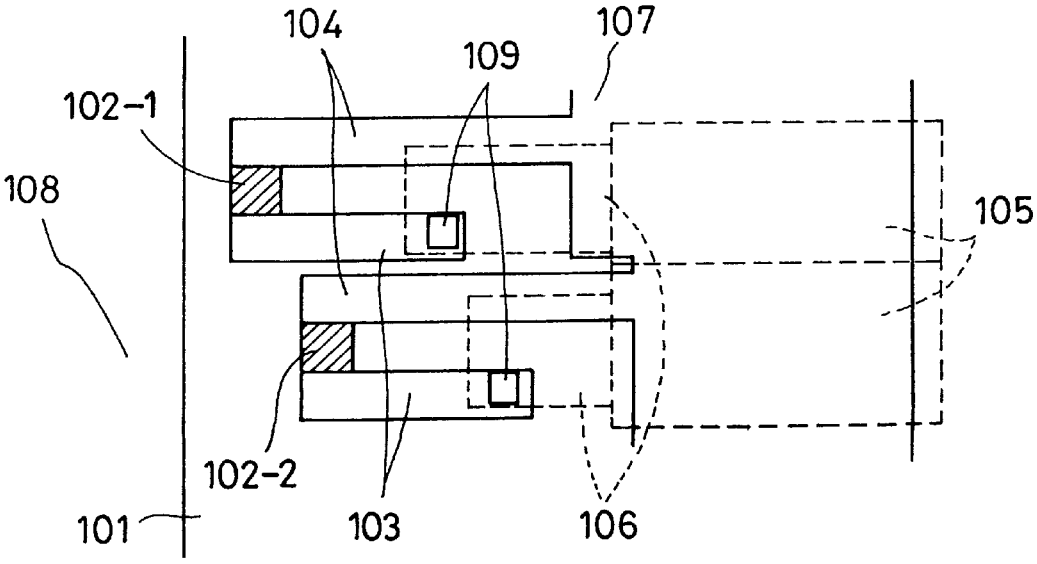
FIG. 2 is a detailed view of the vicinity of the heaters in Embodiment 2 in accordance with the present invention.

FIG. 2 is a detailed plan view showing the vicinity of the heaters in Embodiment 2 in accordance with the present invention.

As with Embodiment 1, driving elements and logic elements are prepared on the silicon substrate by the Bi-CMOS process.

The pitch of the driving elements is the same as the pitch of the heaters, which is 300 dpi.

In the final step of preparing the driving element, the wiring electrode is formed using Al—Cu material that is formed into a thickness of 1.0 μm, followed by patterning and preparation of an inter-layer insulating layer formed from $SiO_2$ material that is formed into a thickness of 1.5 μm.

Then, a 10 μm×10 μm through hole 109 is etched at a location of each inter-layer protective layer where the driving element wiring and the individual heater electrode are connected together.

As shown in FIG. 2, the through holes 109 are formed in correspondence with the positions of the heaters such that the distance between each heater and the through hole 109 is fixed at 50 μm.

Each heater is formed from TaN material that is formed into a thickness of 0.1 μm.

An electrode layer is formed on each heater, using Al material that is formed into a thickness of 0.6 μm, followed by patterning using photolithography, as shown in FIG. 2.

As shown in FIG. 2, the heaters and the common electrode are connected at a location corresponding to the location of the heaters, such that the distance between each heater and the common electrode is the same at 100 μm.

The size of each heater is 30 μm×30 μm.

The thicknesses of the electrodes are the same at 20 μm. Accordingly, it is possible to fix the resistance of a wiring for any heater to a certain value, and thus to apply a fixed voltage to any heater. The distance between the heater and the location where it is connected with the driving element wiring as well as the distance between the heater and the common electrode are fixed, so that the wiring resistance for any heater can be fixed, regardless of its position, even when the overetch amount of the electrode layer changes.

In addition, since the wiring resistance is not adjusted by the distance between the heater and the driving element electrode, the through hole 109 and the heater can be sufficiently spaced apart, thus allowing the through hole 109 to be covered with organic resin or other nozzle forming material.

Embodiment 3

Figure 3:
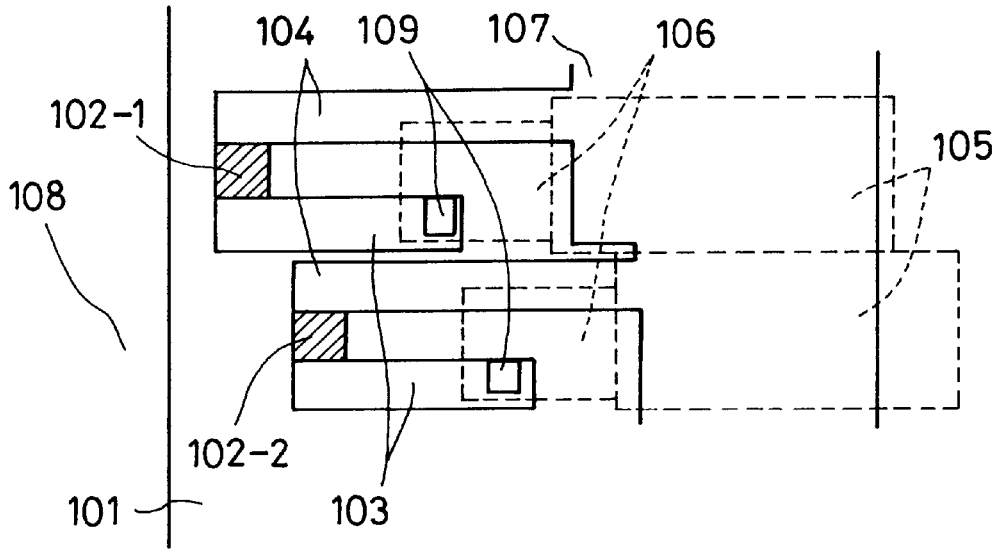
FIG. 3 is a detailed view of the vicinity of the heaters in Embodiment 3 in accordance with the present invention.

FIG. 3 is a detailed plan view of the vicinity of the heaters in Embodiment 3 in accordance with the present invention.

In Embodiments 1 and 2, the wirings 106 between the drive elements and the through holes are formed into different lengths, depending on the location of the heaters. Since the wirings extending from the driving elements to the through holes 109 can be made with a larger film thickness and a larger width, the difference in the resistance values of the wirings in Embodiments 1 and 2 was ignored.

The wiring resistance values need to be corrected when the heaters are greatly displaced from each other, or when the discharge performance varies greatly according to the voltage applied to the heaters, or when the wiring from the driving element to the through hole 109 cannot be made thicker. This can be done by changing the position of the driving element.

A detailed description will now be given of the present embodiment.

As with Embodiment 1, drive elements and logic elements are prepared on a silicon substrate by the Bi-CMOS process.

The pitch of the driving elements is the same as the pitch of the heaters, which is 300 dpi, with the driving elements being disposed in correspondence with the displacement of the heaters, as shown in FIG. 3.

In the final step of preparing the driving elements, a wiring electrode for each driving element is prepared from Al—Cu material that is formed into a thickness of 1.0 μm, followed by patterning and preparation of an inter-layer insulating layer from $SiO_2$ material that is formed into a thickness of 1.5 μm.

Then, a 20 μm×20 μm through hole 109 is etched in a portion of each inter-layer protective layer where the driving element wiring and an individual electrode of the heater is connected together.

As with Embodiment 2, the through holes 109 are formed in correspondence with the locations of the heaters such that the distance A between each heater and the through hole 109 is fixed at 50 μm. The heaters are each formed from TaN material that is formed into a thickness of 0.1 μm.

On each heater is formed an electrode layer composed of Al that is formed into a thickness of 0.6 μm, followed by patterning using photolithography techniques, as shown in FIG. 3.

As with Embodiment 2, each heater and the common electrode is connected at a location in correspondence with the location of the heater such that the distance B between each heater and the common electrode is fixed at 100 μm.

The size of each heater is 25 μm×50 μm. The electrodes are all 30 μm thick. Accordingly, the wiring resistances and the driving element wirings resistances are fixed for any heater, thus allowing a fixed voltage to be applied to the heaters with high precision.

Embodiment 4

Figure 4:
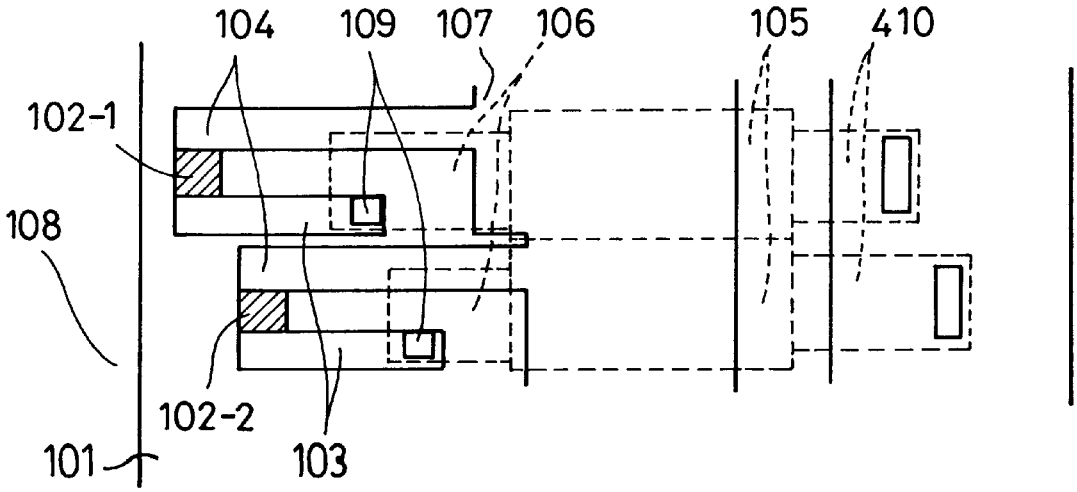
FIG. 4 is a detailed view of the vicinity of the heaters in Embodiment 4 in accordance with the present invention.
Figure 5:
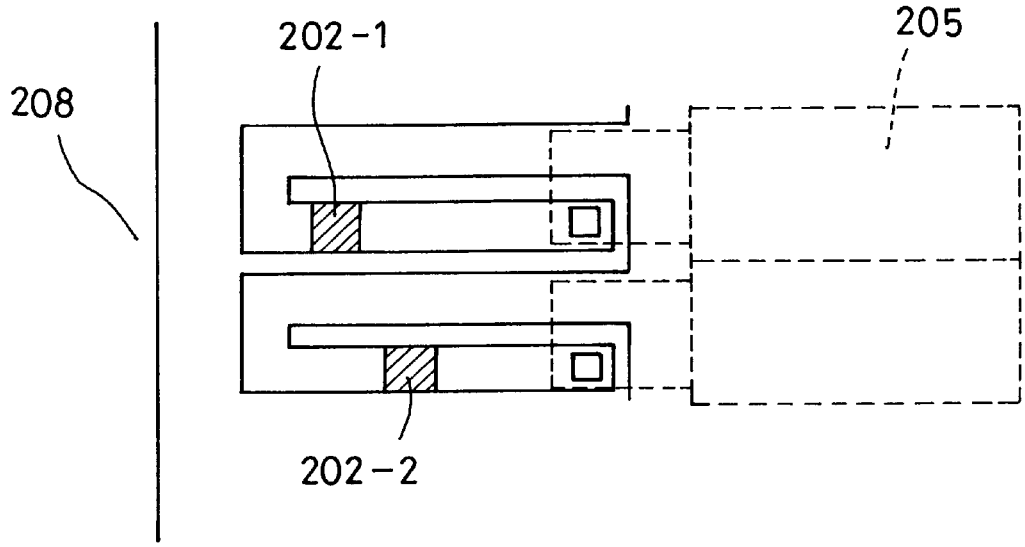
FIG. 5 is a detailed view of the vicinity of the conventional heaters.
Figure 6:
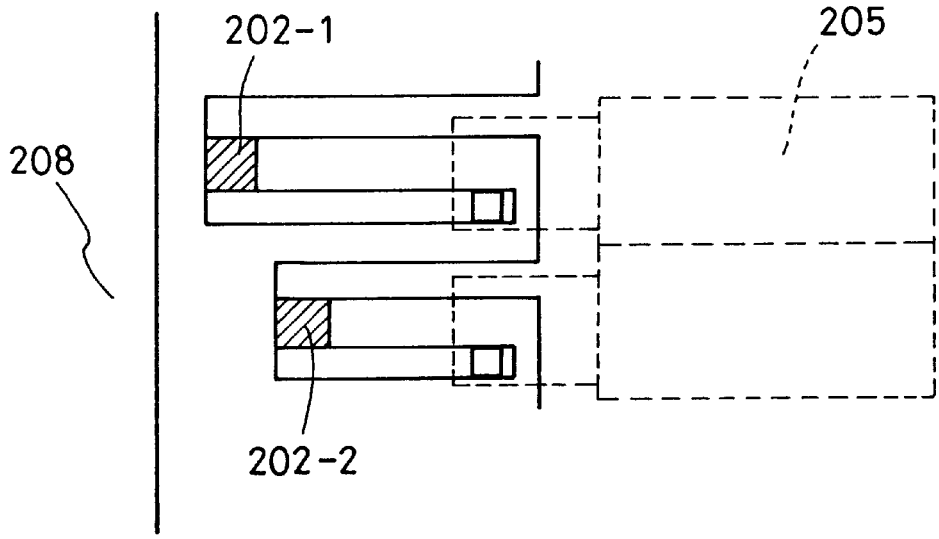
FIG. 6 is a detailed view of the vicinity of the conventional heaters of another embodiment.

FIG. 4 is a detailed plan view of the vicinity of the heaters in Embodiment 4 in accordance with the present invention.

In the present embodiment, when the position of the driving element cannot be changed due to the routing of a logic wiring or the like in Embodiment 3, a fixed voltage can be applied to the heaters by power wirings 410 for inputting electrical power to their respective driving elements.

As shown in FIG. 4, the resistance value of the driving element wiring can be corrected by changing the connecting positions of the power wiring used for inputting electrical power to the driving element.

This allows a fixed voltage to be applied to the heaters with high precision, without changing the position of the driving element.

Figure 10:
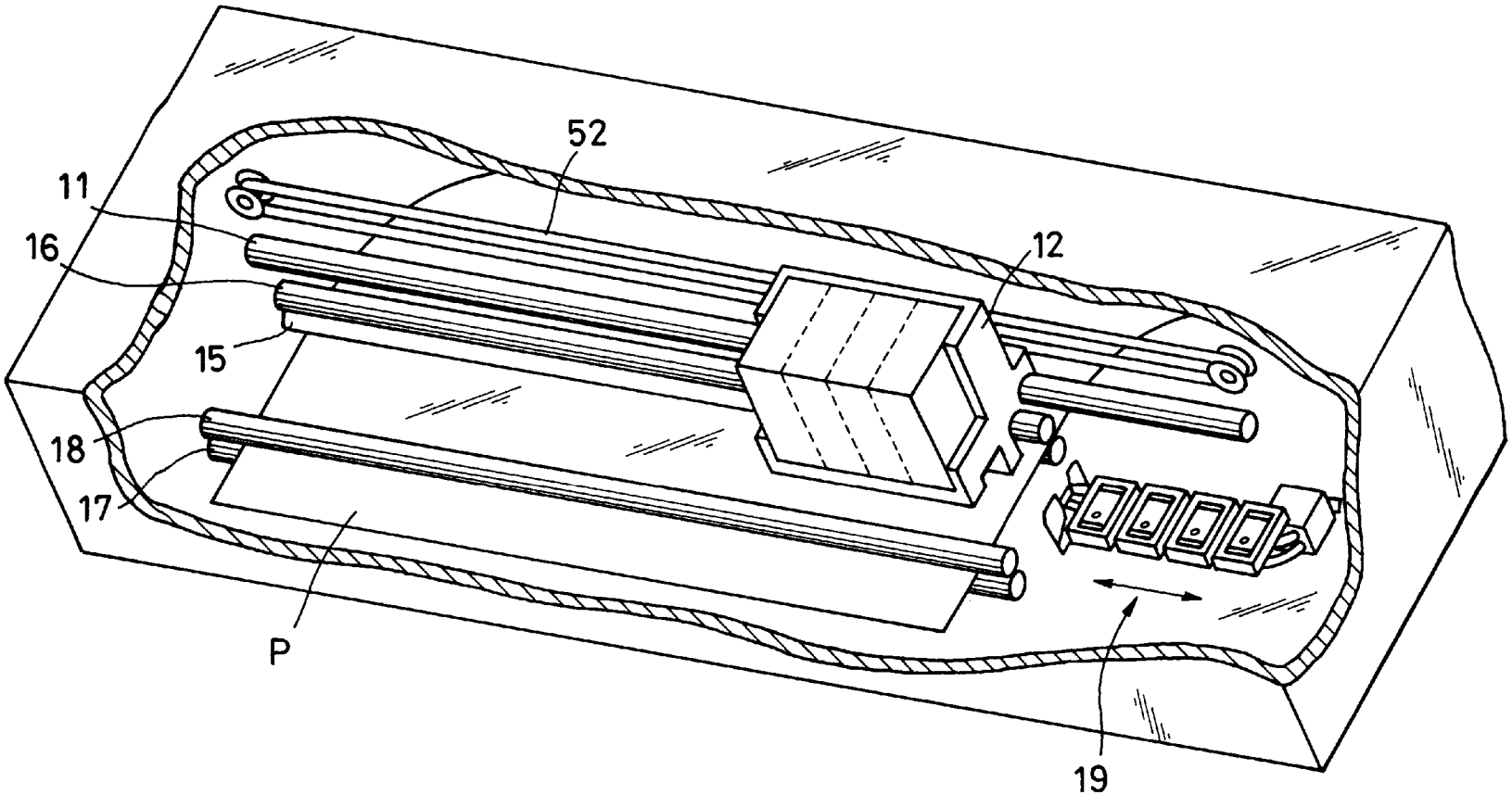
FIG. 10 is a schematic perspective view of an inkjet recording apparatus to which an inkjet recording head can be mounted in accordance with the present invention.

FIG. 10 is a schematic perspective view of an inkjet printer which can use the inkjet recording head described above.

The inkjet heads of each of the above-described embodiments are provided in correspondence with each of the ink types, yellow (Y), magenta (M), cyan (C), and black (BK). These four inkjet heads and tanks containing ink supplied to each of their respective heads are removably carried by a carriage 12. The carriage 12 is slidably mounted to a guide shaft 11, which permits scanning along the guide shaft 11 by a belt 52 run by a motor (not shown). A print medium P is intermittently transported at portions opposing the discharge openings of the inkjet heads during carriage 12 scanning. In other words, the print medium P is intermittently transported by two pairs of conveyor rollers 15 and 16, and 17 and 18 that are rotated by a motor (not shown) as they nip the print medium P at the aforementioned portions opposing the discharge openings.

At the home position of the carriage is provided a recovery unit 19 for performing discharge recovery operations of each of the inkjet heads.

As can be understood from the foregoing description, the inkjet recording head of the present invention can constantly provide good ink discharge performance, without variations in the print quality, by the application of a fixed voltage to the heaters that are displaced from each other. In the inkjet recording head, ink is discharged perpendicular to a substrate provided with an ink discharging means, and each of the heaters disposed side by side on the substrate are driven in a time-sharing fashion, which causes the landing location of the ink on the recording medium to be shifted. This is solved by making the ink land on the proper location by shifting the location of the heaters and the corresponding discharging openings. An element for driving each of the heaters is formed on the substrate.

According to the present invention, a wiring is made thicker when there is a large separation distance between the heater and the connecting portion with the driving element wiring, or a large separation distance between the heater and the common electrode, and the wiring is made thinner when these separation distances are small. This causes the wiring resistance values to be fixed, thereby permitting a fixed voltage to be applied to the heaters.

In addition, according to the present invention, it is also possible to apply a fixed voltage to the heaters by fixing the separation distance between the heater to the connecting location with the driving element wiring, or by fixing separation distance between the heater and the connecting location of the common electrode wiring. This method is used, when the electrode between the heater and the driving element or the distance between the heater and the common electrode is on the whole short, or when resistance value corrections cannot be conducted therebetween, or when wiring corrections cannot be done in accordance with the design, since the wiring over-etch amount is not constant, or when the distance between the connecting location with the driving element wiring and the heater is fixed in order to prevent ink from coming into contact with the connecting location.

Further, according to the present invention, when there is a difference in the resistance values due to a difference in the separation distances between the connecting locations of the driving element wirings and the driving elements, a fixed voltage can be applied to the heaters by shifting the positions of the driving elements.

Still further, according to the present invention, when it is difficult to shift the driving element, such as when it is difficult to route the logic wiring, a fixed voltage can be applied to the heaters by correcting the resistance value of an electrical power wiring used to input electrical power to the driving element.

What is claimed is:

1. An inkjet recording head, comprising:

a plurality of electrothermal conversion members, each said electrothermal conversion member including a heating resistor used for discharging an ink and a pair of electrodes electrically connected to said heating resistor;

a plurality of driving elements, each said driving element being electrically connected to one electrode of said pair of electrodes of an associated said electrothermal conversion member;

a common wiring electrically connected to a second electrode of said pair of electrodes of each of said plurality of electrothermal conversion members;

a plurality of discharge openings for discharging the ink, which are provided in fluid communication with, upwardly of and in correspondence with respective said heating resistors;

an ink path which communicates with said discharge openings; and a slot-shaped ink supply opening in fluid communication with said ink path for supplying the ink to said ink path, wherein said electrothermal conversion members are disposed along said ink supply opening in a longitudinal direction thereof and said heating resistors are arranged in a staggered manner such that shortest distances of said heating resistors from said ink supply opening differ based on a time-sharing driving timings of said heating resistors, and wherein a physical property of at least one electrode of each of said pairs of electrodes is varied to influence the electrical resistance of said at least one electrode of each of said pairs of electrodes, so as to compensate for the staggered arrangement of said electrothermal conversion members by making the ejection characteristics of said electrothermal conversion members substantially the same.

2. An inkjet recording head according to claim 1, wherein said pair of electrodes of said electrothermal conversion member is not disposed between said heating resistor and said ink supply opening.

3. An inkjet recording head according to claim 1, wherein said electrodes and said common wiring are connected at equal distances from their respective said heating resistors for all of said electrothermal conversion members.

4. An inkjet recording head according to claim 1, wherein said electrodes and said driving elements are connected at equal distances from their respective said heating resistors for all of said electrothermal conversion members.

5. An inkjet recording head according to claim 1, wherein the closer a connecting location of said electrode and said common wiring to said heating resistor, or the closer a connecting location of said electrode and said driving element to said heating resistor, the smaller the widths of said pair of electrodes.

6. An inkjet recording head according to claim 1, wherein said driving elements are displaced from each other so as to be disposed at equal distances from their respective said heating resistors which are connected to said driving elements.

7. An inkjet recording head according to claim 1, further comprising an electrical power wiring for inputting an electrical power from said driving elements to said heating resistors, wherein said electrical power wiring is located at equal distances from said heating resistors which are electrically connected to said electrical power wiring.

8. An ink jet recording head according to claim 1, wherein said physical property of said at least one electrode of each of said pairs of electrodes is a shortest distance of a connecting portion between each of said pairs of electrodes and said common wiring from said ink supply.

9. An inkjet recording apparatus comprising:

a carriage for holding an ink jet recording head, said carriage scanning in a direction of arrangement of a plurality of heating resistors of said head and in a direction perpendicular to the direction of arrangement, while said carriage carries said head;

wherein said recording head comprises:

a plurality of electrothermal conversion members, each said electrothermal conversion member including a heating resistor used for discharging an ink and a pair of electrodes electrically connected to said heating resistor;

a plurality of driving elements, each said driving element being electrically connected to a one electrode of said pair of electrodes of an associated said electrothermal conversion member;

a common wiring electrically connected to a second electrode of said pair of electrodes of each of said plurality of electrothermal conversion members;

a plurality of discharge openings for discharging the ink, which are provided in fluid communication with, upwardly of and in correspondence with respective said heating resistors;

an ink path which communicates with said discharge openings; and a slot-shaped ink supply opening in fluid communication with said ink path for supplying the ink to said ink path, wherein said electrothermal conversion members are disposed along said ink supply opening in a longitudinal direction thereof and said heating resistors are arranged in a staggered manner such that shortest distances of said heating resistors from said ink supply opening differ based on a time-sharing driving timings of said heating resistors, and wherein a physical property of at least one electrode of each of said pairs of electrodes is varied to influence the electrical resistance of said at least one electrode of each of said pairs of electrodes, so as to compensate for the staggered arrangement of said electrothermal conversion members by making the ejection characteristics of said electrothermal conversion members substantially the same.

* * * * *